US008876104B2

(12) United States Patent
Koshimura

(10) Patent No.: US 8,876,104 B2
(45) Date of Patent: Nov. 4, 2014

(54) SHEET FEED APPARATUS, AND DOCUMENT CONVEYING APPARATUS AND IMAGE FORMING APPARATUS HAVING THE SAME

(71) Applicant: KYOCERA Document Solutions Inc., Osaka (JP)

(72) Inventor: Yuichi Koshimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/077,107

(22) Filed: Nov. 11, 2013

(65) Prior Publication Data

US 2014/0138903 A1 May 22, 2014

(30) Foreign Application Priority Data

Nov. 19, 2012 (JP) ..... 2012-253278

(51) Int. Cl.
*B65H 3/52* (2006.01)
*G03G 15/00* (2006.01)
*B65H 5/06* (2006.01)

(52) U.S. Cl.
CPC ..... *B65H 3/5223* (2013.01); *G03G 15/6514* (2013.01); *G03G 15/6511* (2013.01); *B65H 5/06* (2013.01)
USPC ..... 271/121; 271/167

(58) Field of Classification Search
CPC ..... B65H 2407/21; B65H 3/5223; B65H 3/0684; G03G 15/6514; G03G 2215/00392
USPC ..... 271/126, 127, 9.09, 121, 167
See application file for complete search history.

(56) References Cited

U.S. PATENT DOCUMENTS

| | | | | |
|---|---|---|---|---|
| 8,490,963 | B2 * | 7/2013 | Miyahara | 271/9.06 |
| 8,651,476 | B2 * | 2/2014 | Bingham et al. | 271/121 |
| 2012/0001377 | A1 * | 1/2012 | Miyahara | 271/9.06 |

FOREIGN PATENT DOCUMENTS

JP 02089737 A 3/1990

* cited by examiner

*Primary Examiner* — Michael McCollough
(74) *Attorney, Agent, or Firm* — Alleman Hall McCoy Russell & Tuttle LLP

(57) ABSTRACT

Sheet conveying path extends from sheet stacking portion. Sheet feed roller is disposed, in sheet conveying path, facing sheet stacking portion. Sheet feed pad is disposed facing circumferential surface of sheet feed roller, and has pad surface that forms, between pad surface and circumferential surface, nip portion into which sheet is conveyed. Support member has support surface to which sheet feed pad is fixed and contact surface located upstream of support surface in sheet conveying direction so as to be higher than pad surface, and configured to make contact with leading end of sheet fed from sheet stacking portion. Rib portions are disposed in support member. Rib portions are disposed on both side portions, in sheet width direction intersecting sheet conveying direction, of support surface, and have inclined surfaces that extend so as to lower front end portions thereof, respectively, from contact surface toward downstream side in sheet conveying direction.

15 Claims, 8 Drawing Sheets

SHEET FEED APPARATUS, AND DOCUMENT CONVEYING APPARATUS AND IMAGE FORMING APPARATUS HAVING THE SAME

INCORPORATION BY REFERENCE

This application is based upon and claims the benefit of priority from the corresponding Japanese Patent Application No. 2012-253278 filed on Nov. 19, 2012, the entire contents of which are incorporated herein by reference.

BACKGROUND

The present disclosure relates to sheet feed apparatuses that feed sheets, and document conveying apparatuses and image forming apparatuses that have the sheet feed apparatuses.

To date, devices that feed sheets one by one from sheet stacking portions to sheet conveying paths have been known as sheet feed devices that feed sheets. The sheet feed device includes a sheet feed roller and a separation pad. The sheet feed roller is driven to rotate, thereby feeding a sheet in a sheet conveying direction. The separation pad contacts with the sheet feed roller, to form a nip portion between the separation pad and a circumferential surface of the sheet feed roller.

A sheet enters the nip portion between the sheet feed roller and the separation pad, and is fed by rotation of the sheet feed roller. A member having a high coefficient of friction is used for the separation pad so as to prevent (simultaneous) feeding of sheets other than an uppermost sheet among the stacked sheets.

In the conventional sheet feed device, a flexible film member having a guiding function is disposed such that, when a sheet enters the nip portion, hitting of a leading end of the sheet against the separation pad is prevented to avoid bending of the sheet. The sheet is conveyed along the film member to enter the nip portion. In this case, the number of components of the sheet feed device is increased by the film member being disposed, thereby increasing cost for the sheet feed device. Further, an operation for mounting the film member to the sheet feed device is necessary for assembling the sheet feed device.

SUMMARY

A sheet feed apparatus according to one aspect of the present disclosure includes a sheet stacking portion, a sheet conveying path, a sheet feed roller, a sheet feed pad, a support member, and rib portions. Sheets are stacked on the sheet stacking portion. The sheet conveying path extends from the sheet stacking portion. In the sheet conveying path, the sheet is conveyed in a predetermined conveying direction. The sheet feed roller is disposed, in the sheet conveying path, facing the sheet stacking portion. The sheet feed roller has a circumferential surface being rotated. The sheet feed roller is configured to convey the sheet. The sheet feed pad is disposed facing the circumferential surface of the sheet feed roller, and has a pad surface that forms, between the pad surface and the circumferential surface, a nip portion into which the sheet is conveyed. The support member has a support surface to which the sheet feed pad is fixed, and a contact surface located upstream of the support surface in a sheet conveying direction so as to be higher than the pad surface, and configured to make contact with a leading end of the sheet fed from the sheet stacking portion. The rib portions are disposed in the support member. The rib portions are disposed on both side portions, in a sheet width direction intersecting the sheet conveying direction, of the support surface, and the rib portions have inclined surfaces that extend so as to lower front end portions thereof, respectively, from the contact surface toward a downstream side in the sheet conveying direction.

An image forming apparatus according to another aspect of the present disclosure includes a sheet stacking portion, a sheet conveying path, a sheet feed roller, a sheet feed pad, a support member, rib portions, and an image forming portion. Sheets are stacked on the sheet stacking portion. The sheet conveying path extends from the sheet stacking portion. In the sheet conveying path, the sheet is conveyed in a predetermined conveying direction. The sheet feed roller is disposed, in the sheet conveying path, facing the sheet stacking portion. The sheet feed roller has a circumferential surface being rotated. The sheet feed roller is configured to convey the sheet. The sheet feed pad is disposed facing the circumferential surface of the sheet feed roller, and has a pad surface that forms, between the pad surface and the circumferential surface, a nip portion into which the sheet is conveyed. The support member has a support surface to which the sheet feed pad is fixed, and a contact surface located upstream of the support surface in a sheet conveying direction, so as to be higher than the pad surface, and configured to make contact with a leading end of the sheet fed from the sheet stacking portion. The rib portions are disposed in the support member. The rib portions are disposed on both side portions, in a sheet width direction intersecting the sheet conveying direction, of the support surface, and the rib portions have inclined surfaces that extend so as to lower front end portions thereof, respectively, from the contact surface toward a downstream side in the sheet conveying direction. The image forming portion forms an image on the sheet conveyed by the sheet feed roller.

A document conveying apparatus according to still another aspect of the present disclosure is attached to an image reading apparatus. The document conveying apparatus conveys a document to the image reading apparatus. The document conveying apparatus includes a sheet stacking portion, a sheet conveying path, a sheet feed roller, a sheet feed pad, a support member, and rib portions. Documents are stacked on the sheet stacking portion. The sheet conveying path extends from the sheet stacking portion. In the sheet conveying path, the document is conveyed in a predetermined conveying direction. The sheet feed roller is disposed, in the sheet conveying path, facing the sheet stacking portion. The sheet feed roller has a circumferential surface being rotated. The sheet feed roller is configured to convey the document. The sheet feed pad is disposed facing the circumferential surface of the sheet feed roller, and has a pad surface that forms, between the pad surface and the circumferential surface, a nip portion into which the document is conveyed. The support member has a support surface to which the sheet feed pad is fixed, and a contact surface located upstream of the support surface in a sheet conveying direction so as to be higher than the pad surface, and configured to make contact with a leading end of the document fed from the sheet stacking portion. The rib portions are disposed in the support member. The rib portions are disposed on both side portions, in a sheet width direction intersecting the sheet conveying direction, of the support surface, and the rib portions have inclined surfaces that extend so as to lower front end portions thereof, respectively, from the contact surface toward a downstream side in the sheet conveying direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
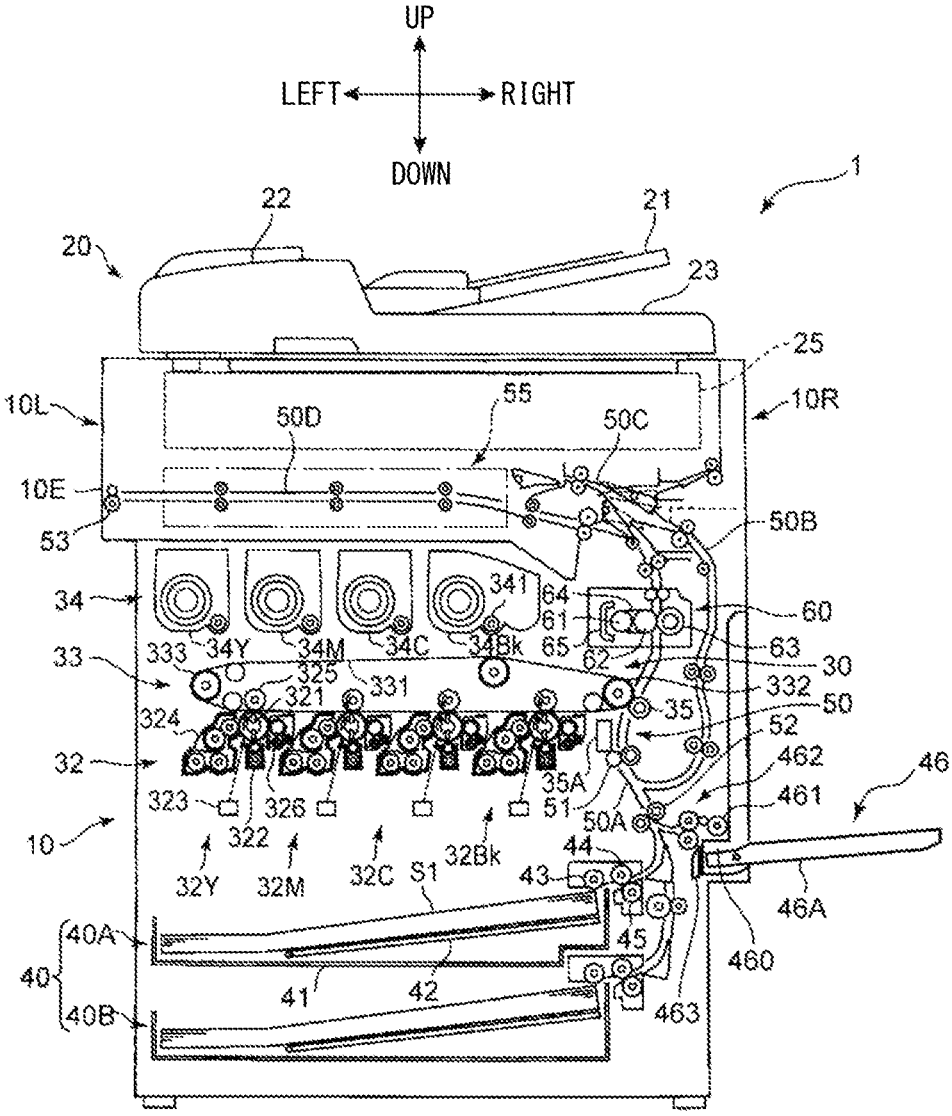
FIG. 1 is a cross-sectional view of an internal structure of an image forming apparatus according to an embodiment of the present disclosure.

Hereinafter, an embodiment of the present disclosure will be described in detail with reference to the drawings. FIG. 1 is a cross-sectional view of an internal structure of an image forming apparatus 1 according to one embodiment of the present disclosure. In the description herein, a multifunctional peripheral having a function of a printer and a copying function is illustrated as the image forming apparatus 1. However, the image forming apparatus may be a printer, a copy machine, or a facsimile apparatus.

<Image forming apparatus>

The image forming apparatus 1 includes an apparatus body 10 that is structured as a housing shaped in almost a rectangular parallelepiped, and an automatic document feeder 20 (Document conveying apparatus) disposed on the apparatus body 10. In the apparatus body 10, a reading unit 25, an image forming portion 30, a fixing portion 60, a sheet feed portion 40, a conveying path 50, and a conveying unit 55 are accommodated. The reading unit 25 optically reads a document image to be copied. The image forming portion 30 forms a toner image on a sheet. The fixing portion 60 fixes the toner image onto the sheet. The sheet feed portion 40 stores regular sheets to be conveyed to the image forming portion 30. The conveying path 50 functions to convey the regular sheet from the sheet feed portion 40 or a manual sheet feed portion 46 to a sheet discharge outlet 10E through the image forming portion 30 and the fixing portion 60. The conveying unit 55 includes therein a sheet conveying path that is a part of the conveying path 50.

The automatic document feeder (ADF) 20 is pivotably mounted on the top surface of the apparatus body 10. The ADF 20 automatically feeds a document to be copied, toward a predetermined document reading position in the apparatus body 10. On the other hand, when a user manually places a document at the predetermined document reading portion, the ADF 20 is opened upward. The ADF 20 includes a document tray 21 on which documents are placed, a document conveying portion 22 that conveys documents through the automatic document reading position, and a document discharge tray 23 onto which the documents having been read are discharged.

The reading unit 25 optically reads an image on a document through a contact glass for reading of a document that is automatically fed from the ADF 20 disposed on the top surface of the apparatus body 10, or a contact glass (not shown) for reading of a document that is manually placed. In the reading unit 25, a scanning mechanism having: a light source; a movable carriage; a reflective mirror; and the like, and an imaging device are accommodated, which is not shown. By the scanning mechanism, light is applied to a document, and light reflected by the document is guided to the imaging device. The imaging device performs photoelectric conversion in which the reflected light is converted to an analog electric signal. The analog electric signal is converted to a digital electric signal by an A/D converter circuit, and is thereafter inputted to the image forming portion 30. An image reading device is formed by the automatic document feeder (ADF) 20 and the reading unit 25.

The image forming portion 30 performs a process of generating a full color toner image, and transferring the full color toner image onto a sheet. The image forming portion 30 includes an image forming unit 32, an intermediate transfer unit 33, and a toner supply portion 34. The image forming unit 32 includes four units 32Y, 32M, 32C, and 32Bk that are aligned in conjunction with each other, and that form yellow (Y), magenta (M), cyan (C), and black (Bk) toner images, respectively. The intermediate transfer unit 33 is disposed on and adjacent to the image forming unit 32. The toner supply portion 34 is disposed above the intermediate transfer unit 33.

Each of the image forming units 32Y, 32M, 32C, and 32Bk includes a photosensitive drum 321, and includes a charging unit 322, an exposure unit 323, a developing device 324, a primary transfer roller 325, and a cleaning device 326 that are disposed around the photosensitive drum 321.

The photosensitive drum 321 rotates about its axis, and has a circumferential surface on which an electrostatic latent image and a toner image are formed. As the photosensitive drum 321, a photosensitive drum formed by an amorphous-silicon (a-Si)-based material, may be used. The surface of the photosensitive drum 321 is uniformly charged by the charging unit 322. The exposure unit 323 includes a laser light source and optical components such as a mirror and a lens, and applies light based on image data of a document image, to the circumferential surface of the photosensitive drum 321, to form an electrostatic latent image.

The developing device 324 supplies toner to the circumferential surface of the photosensitive drum 321 in order to develop the electrostatic latent image formed on the photosensitive drum 321. The developing device 324 is for a two-component developer, and includes a screw feeder, a magnetic roller, and a developing roller.

The primary transfer roller 325 and the photosensitive drum 321 nip therebetween an intermediate transfer belt 331 provided in the intermediate transfer unit 33, to form a primary transfer nip portion, and primary transfer in which the toner image on the photosensitive drum 321 is transferred onto the intermediate transfer belt 331 is performed. The cleaning device 326 includes a cleaning roller or the like, and cleans the circumferential surface of the photosensitive drum 321 from which the toner image has been transferred.

The intermediate transfer unit 33 includes the intermediate transfer belt 331, a driving roller 332, and a follower roller 333. The intermediate transfer belt 331 is an endless belt that extends on and between the driving roller 332 and the follower roller 333. Onto the same portion on the outer circumferential surface of the intermediate transfer belt 331, toner images are transferred from a plurality of the photosensitive drums 321, so as to be superimposed on each other (primary transfer).

A secondary transfer roller 35 is disposed so as to face the circumferential surface of the driving roller 332. A nip portion formed between the driving roller 332 and the secondary transfer roller 35 acts as a secondary transfer nip portion that transfers, onto a sheet, a full color toner image obtained on the intermediate transfer belt 331 by images being superimposed on each other. A secondary transfer bias potential having a polarity opposite to that of the toner image is applied to one of the driving roller 332 or the secondary transfer roller 35, and the other thereof is grounded.

The toner supply portion 34 includes a yellow-toner container 34Y, a magenta-toner container 34M, a cyan-toner container 34C, and a black-toner container 34Bk. The toner containers 34Y, 34C, 34M, and 34Bk store toners of respective colors, and the toners of the colors are supplied, through not-illustrated supply paths, to the developing devices 324 of the image forming units 32Y, 32M, 32C, and 32Bk corresponding to YMCBk colors, respectively. Each of the toner containers 34Y, 34C, 34M, and 34Bk includes a conveying screw 341 that conveys the toner in the container to a not-illustrated toner discharge outlet. The conveying screw 341 is driven to rotate by a not-illustrated driving portion, thereby supplying the toner into the developing device 324.

The sheet feed portion 40 includes two cassettes, that is, a first sheet feed cassette 40A and a second sheet feed cassette 40B, which store regular sheets S1 among sheets on which image forming process is to be performed. These sheet feed cassettes can be drawn forward from the front of the apparatus body 10.

The first sheet feed cassette 40A includes a sheet storage portion 41 that stores a stack of sheets formed by the regular sheets S1 being stacked, and a lifting plate 42 that lifts the stack of sheets for sheet feeding. Above the right end portion of the sheet feed cassette 40A, a pick-up roller 43, and paired rollers formed by a sheet feed roll 44 and a retard roller 45, are disposed. Due to driving of the pick-up roller 43 and the sheet feed roll 44, the sheets S1 in the uppermost layer of the stack of sheets in the sheet feed cassette 40A are fed one by one, and conveyed to the upstream end of the conveying path 50. The second sheet feed cassette 40B has the same structure as the first sheet feed cassette 40A.

On a right side surface 10R of the apparatus body 10, the manual sheet feed portion 46 (sheet feed apparatus) is disposed. The manual sheet feed portion 46 includes a manual feed tray 46A (sheet stacking portion) for manual sheet feeding, and a sheet feed roller 461. The manual feed tray 46A is mounted to the apparatus body 10 at the lower end portion thereof, so as to be openable and closable. When manual sheet feeding is performed by a user, the user opens the manual feed tray 46A as shown in the drawings, and places a sheet thereon. The sheet placed on the manual feed tray 46A is conveyed into a manually-fed-sheet conveying path 460 (sheet conveying path) that extends from the manual feed tray 46A, by the sheet feed roller 461 and a pair of conveying rollers 462 being driven. Further, the sheet is conveyed from the manually-fed-sheet conveying path 460 into the conveying path 50.

The conveying path 50 includes a main conveying path 50A, a reverse conveying path 50B, a switching conveying path 50C, and a horizontal conveying path 50D. The main conveying path 50A conveys a sheet (regular sheet S1) from the sheet feed portion 40 through the image forming portion 30 to an exit of the fixing portion 60. The reverse conveying path 50B returns a sheet on which one-side printing has been performed, to the image forming portion 30, when duplex printing is to be performed on the sheet. The switching conveying path 50C diverts the sheet from the downstream end of the main conveying path 50A toward the upstream end of the reverse conveying path 50B. The horizontal conveying path 50D horizontally conveys the sheet from the downstream end of the main conveying path 50A to the sheet discharge outlet 10E disposed on a left side surface 10L of the apparatus body 10. A great part of the horizontal conveying path 50D is formed as a sheet conveying path accommodated in the conveying unit 55.

A pair of registration rollers 51 is disposed, in the main conveying path 50A, upstream of the secondary transfer nip portion. A sheet is temporarily stopped at the pair of registration rollers 51 that is at a stop, to perform skew correction. Thereafter, the pair of registration rollers 51 is driven to rotate by a driving motor (not shown) at a predetermined time for image transfer, thereby feeding the sheet to the secondary transfer nip portion. In addition, a plurality of sheet conveying rollers 52 are disposed in the main conveying path 50A in order to convey sheets.

A sheet discharge roller 53 is disposed at the end, on the downstream side, of the conveying path 50. The sheet discharge roller 53 feeds a sheet through the sheet discharge outlet 10E to a not-illustrated post-processing device disposed on the left side surface 10L of the apparatus body 10. In the image forming apparatus that has no post-processing device mounted, a sheet discharge tray is provided below the sheet discharge outlet 10E.

The conveying unit 55 is a unit that conveys, to the sheet discharge outlet 10E, a sheet conveyed from the fixing portion 60. In the image forming apparatus 1 of the present embodiment, the fixing portion 60 is disposed on the right side surface 10R side of the apparatus body 10, and the sheet discharge outlet 10E is disposed on the left side surface 10L side, of the apparatus body 10, which faces the right side surface 10R. Therefore, the conveying unit 55 horizontally conveys a sheet from the right side surface 10R side toward the left side surface 10L in the apparatus body 10.

The fixing portion 60 is an induction heating type fixing device that performs a fixing process for fixing a toner image onto a sheet, and includes a heating roller 61, a fixing roller 62, a pressurizing roller 63, a fixing belt 64, and an induction heating unit 65. The pressurizing roller 63 is pressed against the fixing roller 62, to form a fixing nip portion. The heating roller 61 and the fixing belt 64 are induction-heated by the induction heating unit 65, and the heat is applied to the fixing nip portion. By the sheet passing through the fixing nip portion, a toner image having been transferred to the sheet is fixed onto the sheet.

<Manual Sheet Feed Portion 46>

Figure 2:
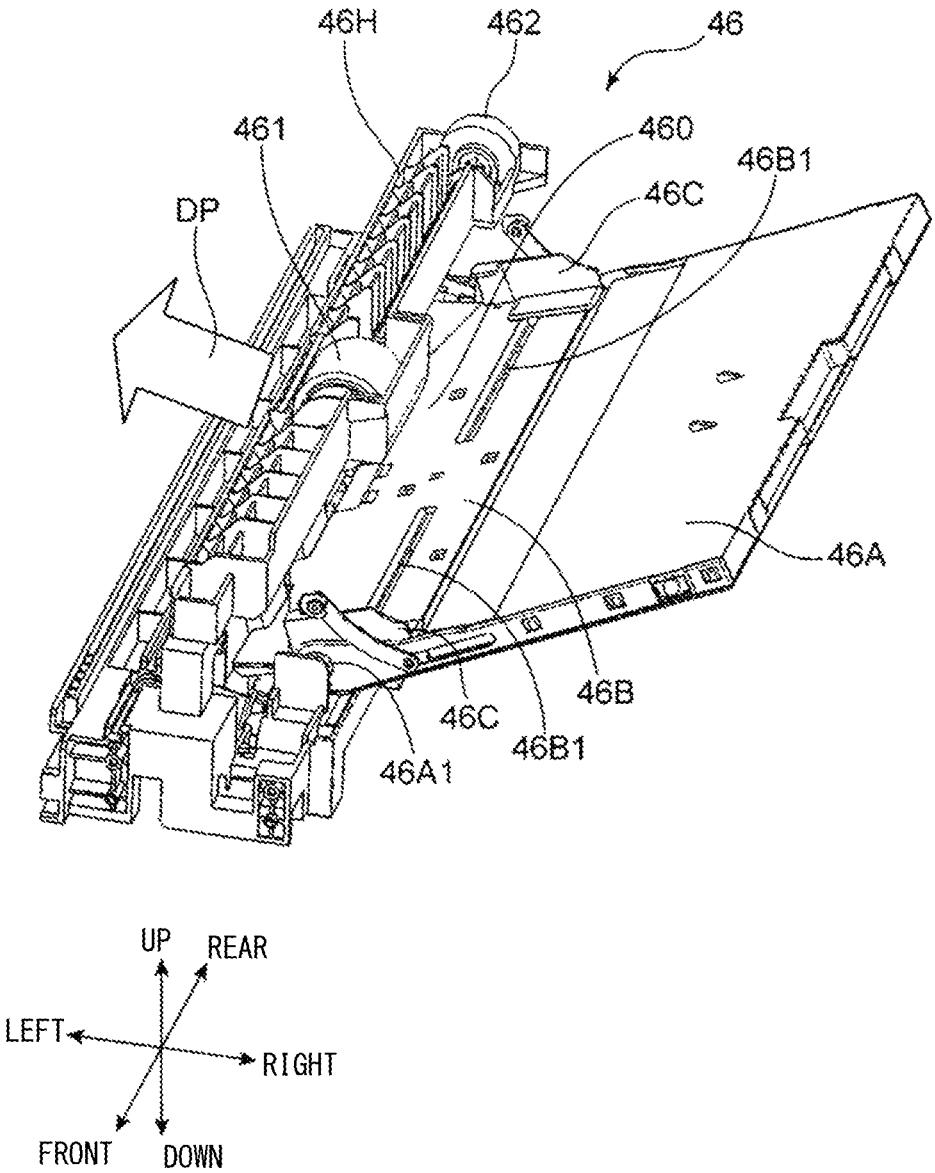
FIG. 2 is a perspective view of a manual sheet feed portion according to an embodiment of the present disclosure.
Figure 3:
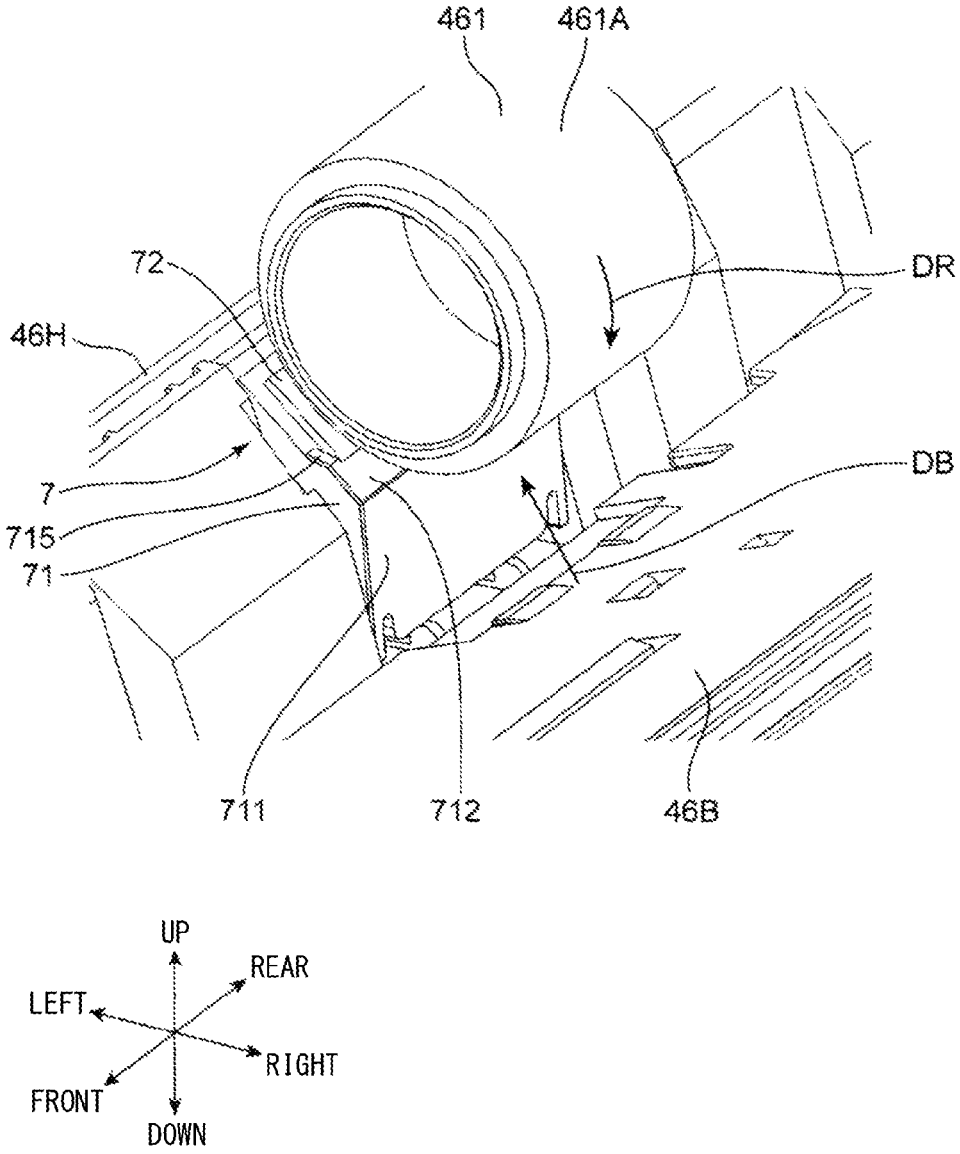
FIG. 3 is an enlarged perspective view of a part of the manual sheet feed portion according to an embodiment of the present disclosure.
Figure 4:
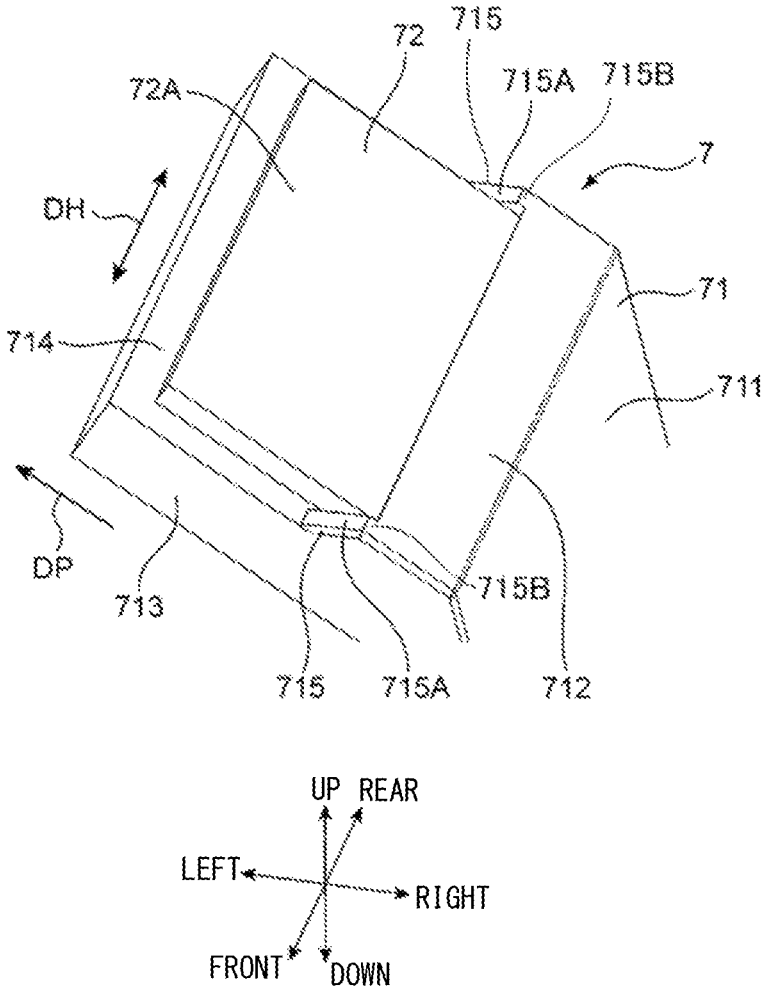
FIG. 4 is a perspective view of a separation pad portion according to an embodiment of the present disclosure.

Next, the manual sheet feed portion 46 according to the present embodiment will be described in detail with reference to FIG. 2 to FIG. 4. FIG. 2 is a perspective view of the manual sheet feed portion 46 according to the present embodiment. FIG. 3 is an enlarged perspective view of a part of the manual sheet feed portion 46. FIG. 4 is a perspective view of a separation pad portion 7.

As shown in FIG. 2, the manual sheet feed portion 46 includes the manual feed tray 46A as described above, a manual feed lifting plate 46B, width regulation guides 46C, the sheet feed roller 461, and a housing 46H.

The manual feed tray 46A is a plate-like member that is openable and closable relative to the right side surface 10R (FIG. 1) of the apparatus body 10. An upper portion of the manual feed tray 46A is pivotable about a pivot portion 46A1. A plurality of sheets are stacked on the manual feed tray 46A. The manually-fed-sheet conveying path 460 to which a sheet is convened from the manual feed tray 46A, extends in the direction indicated by an arrow DP in FIG. 2.

The manual feed lifting plate 46B is a part of the top surface portion of the manual feed tray 46A, and is disposed on the left side (downstream side in the sheet conveying direction) of the manual feed tray 46A. The left end portion of the manual feed lifting plate 46B is movable in the up-down direction by a not-illustrated driving mechanism. By the manual feed lifting plate 46B being moved, a leading end portion (left end portion) of a stack of sheets stacked on the manual feed tray 46A is moved upward. As a result, the leading end portions of the sheets contact with the sheet feed roller 461.

The width regulation guides 46C are disposed on the manual feed lifting plate 46B. The width regulation guides 46C are disposed on the front side and the rear side, respectively, so as to be paired, and regulate a position, in the width direction, of a sheet. The width regulation guides 46C are movable, in the front-rear direction, along guide grooves 46B1 formed in the manual feed lifting plate 46B.

The sheet feed roller 461 is disposed in the manually-fed-sheet conveying path 460 so as to face the manual feed tray 46A. The sheet feed roller 461 has a circumferential surface 461A (see FIG. 3, FIG. 5) that is rotated, and conveys a sheet in the sheet conveying direction (the direction indicated by the arrow DP in FIGS. 2 and 4). The housing 46H has a box-like shape that extends in the front-rear direction. The housing 46H supports the sheet feed roller 461 in the center portion in the front-rear direction such that the sheet feed roller 461 is rotatable. Further, a driving gear 462 is disposed in the rear end portion of the housing 46H. The driving gear 462 connects to the sheet feed roller 461 through a not-illustrated shaft. The driving gear 462 is rotated by a not-illustrated driving motor, to rotate the sheet feed roller 461 through the shaft.

As shown in FIG. 3 and FIG. 4, the manual sheet feed portion 46 further includes the separation pad portion 7. The separation pad portion 7 has a function of preventing sheets, other than an uppermost sheet, in a stack of sheets stacked on the manual feed tray 46A from being conveyed toward a nip portion N. The separation pad portion 7 includes a separation pad 72 (sheet feed pad) and a pad holder 71 (support member).

The separation pad 72 is disposed so as to face the circumferential surface 461A of the sheet feed roller 461. The separation pad 72 includes a separation surface 72A (pad surface) that forms, between the separation surface 72A and the circumferential surface 461A, the nip portion N into which a sheet is conveyed. The separation pad 72 is a plate-like elastic member. For example, the separation pad 72 may be formed as a rubber member. The separation surface 72A of the separation pad 72 has such a coefficient of friction that a friction between the separation surface 72A and a sheet is high. Due to a frictional force between a sheet and the separation surface 72A, sheets, other than an uppermost sheet, in a stack of sheets are prevented from being conveyed downstream in the sheet conveying direction.

The pad holder 71 is disposed in the center portion, in the front-rear direction, of the housing 46H. The pad holder 71 supports the separation pad 72. The pad holder 71 has a facing surface 711, a contact surface 712, side surface portions 713, a support surface 714, and ribs 715 (rib portions).

The facing surface 711 is a wall portion that is disposed in the right side portion of the pad holder 71 so as to extend in almost the up-down direction. The facing surface 711 is disposed so as to intersect the left end portion of the manual feed lifting plate 46B. When the manual feed lifting plate 46B is moved in the up-down direction as described above, the head portion (the left end portion) of the manual feed lifting plate 46B is moved in the up-down direction while facing the facing surface 711.

The contact surface 712 is disposed so as to intersect the facing surface 711 in the upper end portion of the facing surface 711. When a cross-section intersecting the sheet width direction (the direction indicated by an arrow DH in FIG. 4) is viewed, the contact surface 712 extends so as to be inclined from the lower right side toward the upper left side. The contact surface 712 is disposed upstream of the separation pad 72 in the sheet conveying direction so as to be raised upward relative to the separation surface 72A. A leading end of a sheet fed from the manual feed tray 46A contacts with the contact surface 712.

The side surface portions 713 are formed as a pair of side walls that forms side surfaces, in the front-rear direction, of the pad holder 71. In FIG. 3 and FIG. 4, the side wall on the front side in the side surface portions 713 is shown.

Figure 6:
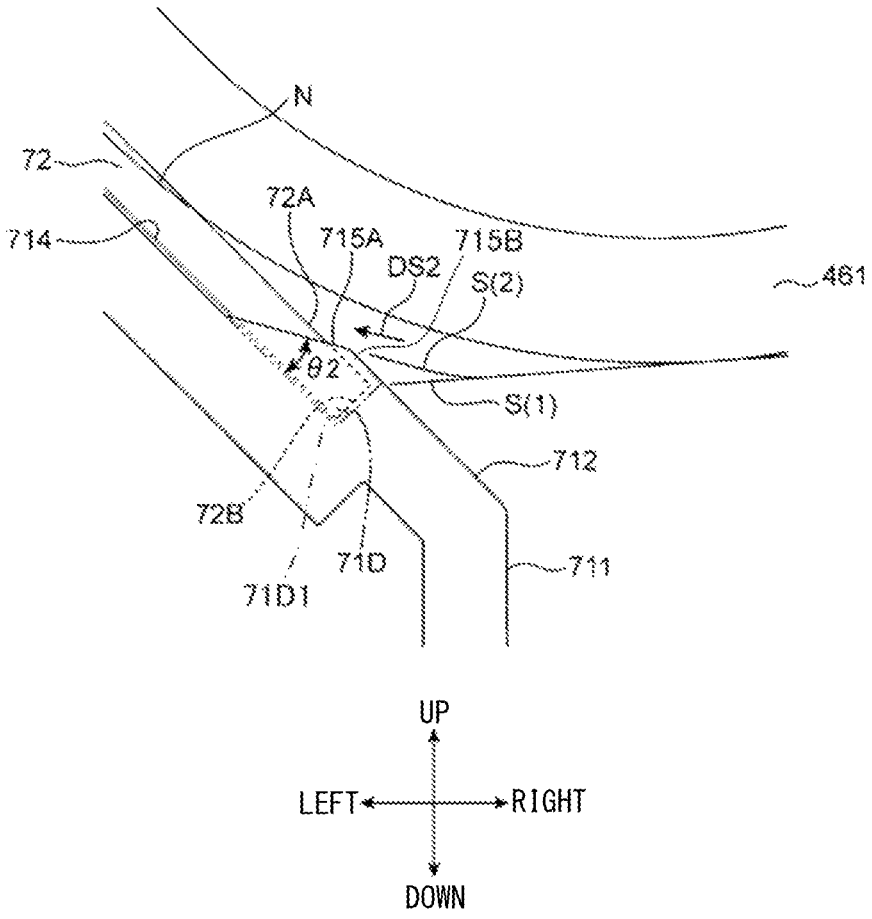
FIG. 6 is a cross-sectional view illustrating a state where a sheet is conveyed toward a separation surface.

The support surface 714 is disposed downstream of the contact surface 712 in the sheet conveying direction, so as to be stepped from the contact surface 712. Specifically, a stepped portion 71D is formed between the contact surface 712 and the support surface 714 so as to be erected from the support surface 714 toward the contact surface 712 (see FIG. 6). To the support surface 714, the separation pad 72 is fixed. In the present embodiment, the separation pad 72 is adhered and fixed to the support surface 714. At this time, the separation pad 72 is disposed on the support surface 714 such that an upstream-side end portion 72B of the separation pad 72 faces a step surface 71D1, on the support surface 714 side, of the stepped portion 71D (FIG. 6).

The ribs 715 are disposed on both side portions, in the sheet width direction (the direction indicated by the arrow DH in FIG. 4), of the support surface 714 to which the separation pad 72 is fixed. The ribs 715 connect between the contact surface 712 and the support surface 714. Each rib 715 has an inclined surface 715A that extends so as to lower its front end portion from the contact surface 712 side toward the downstream side in the sheet conveying direction (the direction indicated by the arrow DP in FIG. 4). Each rib 715 (the inclined surface 715A) is disposed downward of the step surface 71D1 of the stepped portion 71D (FIG. 6) in the sheet conveying direction. Further, each rib 715 has a parallel surface 715B between the inclined surface 715A and the contact surface 712. The parallel surface 715B connects to the contact surface 712, and is coplanar with the contact surface 712. In the below description, "extend so as to lower its front end portion in the sheet conveying direction" represents "inclined so as to deviate from the sheet conveying direction, toward the downstream side in the sheet conveying direction". Namely, in the present embodiment, a sheet S is conveyed in the upper-left direction (in the sheet conveying direction) so as to pass through the nip portion N formed between the sheet feed roller 461 and the separation pad 72. Therefore, the inclined surface 715A that has such a shape as to lower its front end portion toward the downstream side in the sheet conveying direction, is actually inclined by a small inclination angle and extends in the upper-left direction. In other words, "such a shape as to lower its front end portion" as described above represents a shape relative to the sheet conveying direction, and does not define an inclination angle of the inclined surface 715A.

Figure 5:
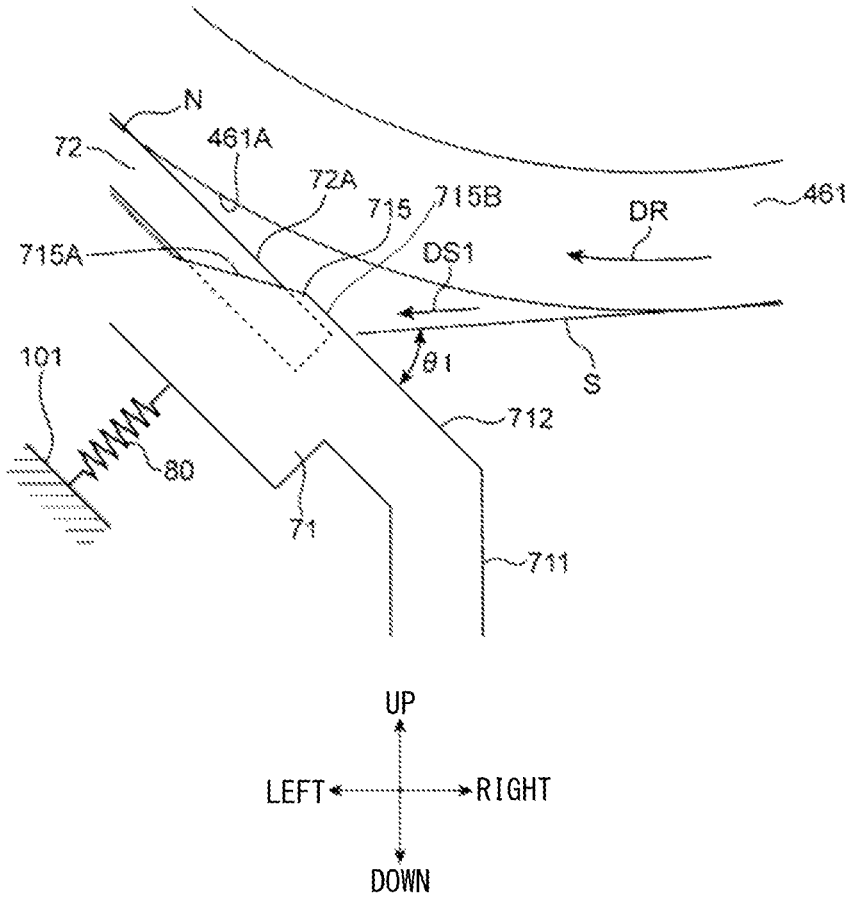
FIG. 5 is a cross-sectional view illustrating a state where a sheet is conveyed toward a contact surface.

Further, the manual sheet feed portion 46 has an urging spring 80 (FIG. 5).

The urging spring 80 is disposed between the pad holder 71 and a wall portion 101 of the apparatus body 10. The pad holder 71 is urged in the upper right direction by the urging spring 80. As a result, the separation pad 72 is pressed against the circumferential surface 461A of the sheet feed roller 461, thereby forming the nip portion N.

In FIG. 3, when the manual feed lifting plate 46B is moved upward as indicated by an arrow DB, an uppermost sheet in a stack of sheets stacked on the manual feed tray 46A contacts with the circumferential surface 461A of the sheet feed roller 461. When the sheet feed roller 461 is rotated in the direction indicated by an arrow DR, the sheet is conveyed toward the nip portion N (FIG. 5) between the sheet feed roller 461 and the separation pad 72.

Figure 7:
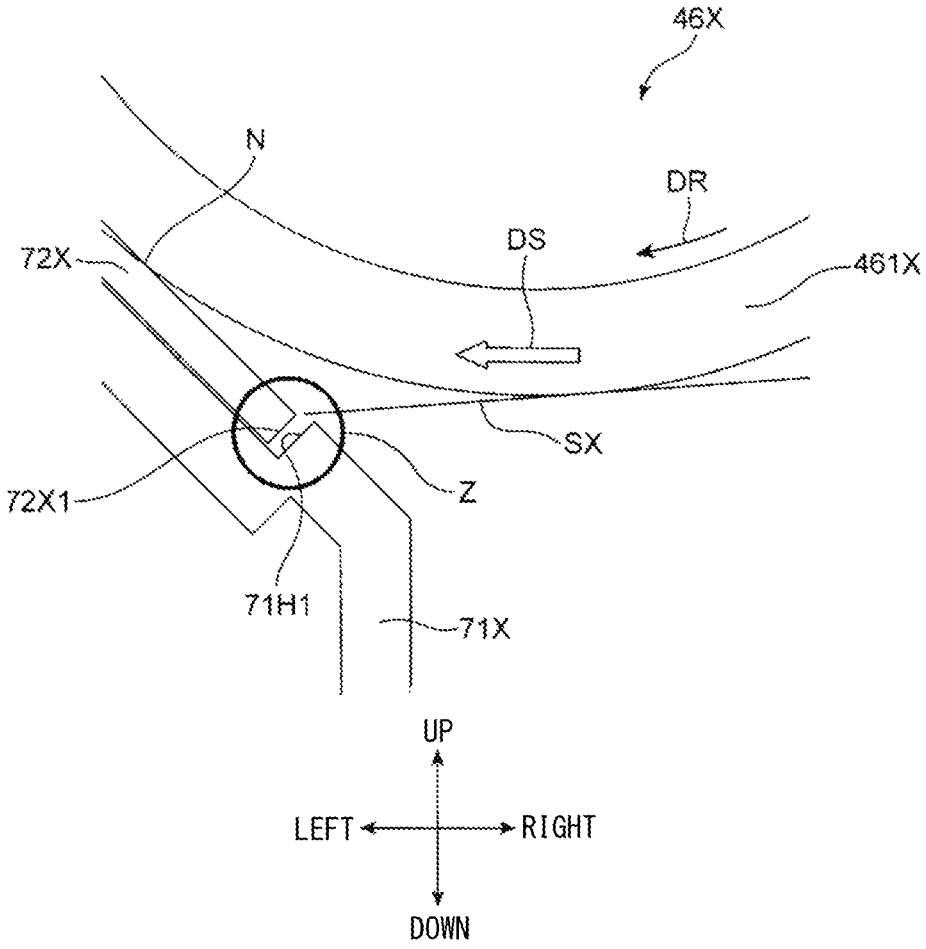
FIG. 7 is an enlarged cross-sectional view of a part of a manual sheet feed portion as compared to the manual sheet feed portion according to one embodiment of the present disclosure.
Figure 8:
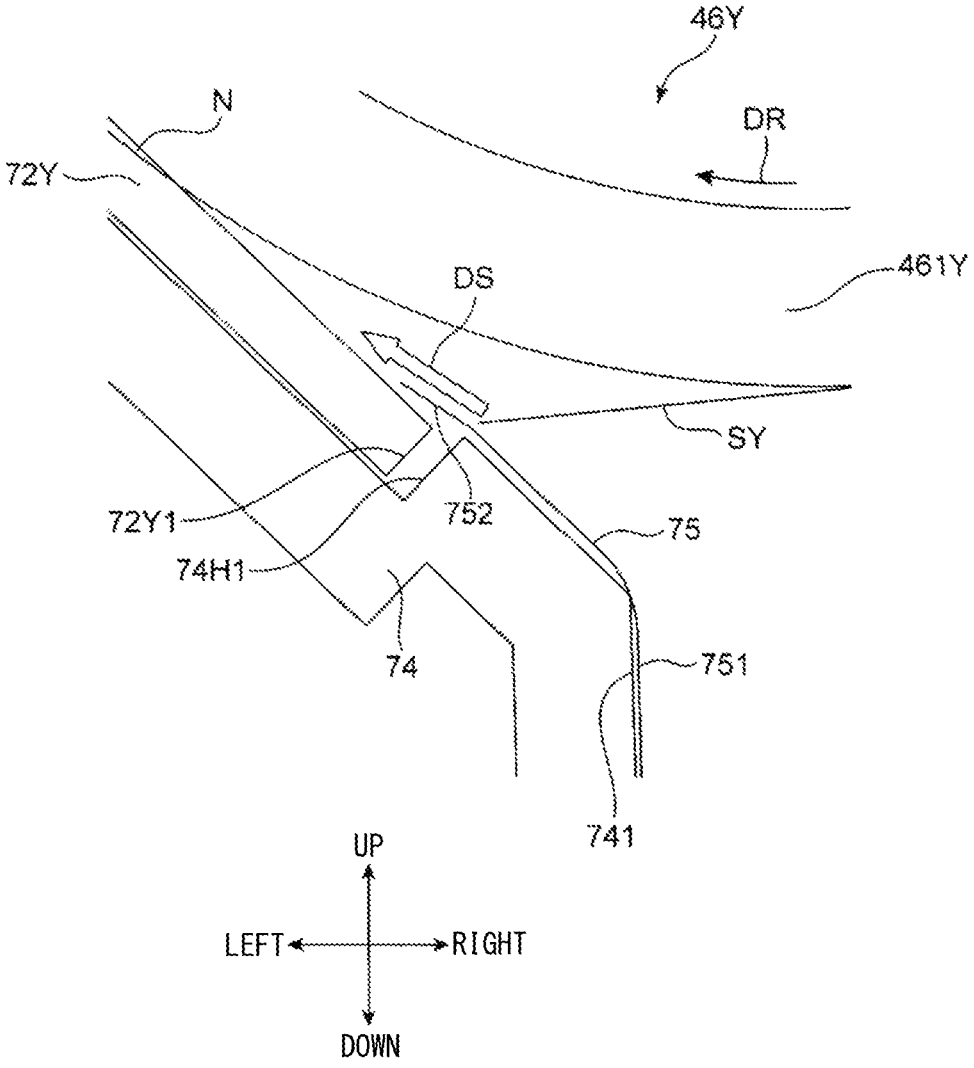
FIG. 8 is an enlarged cross-sectional view of a part of another manual sheet feed portion as compared to the manual sheet feed portion according to one embodiment of the present disclosure.

Next, problems with a manual sheet feed portion 46X and a manual sheet feed portion 46Y as compared to the manual sheet feed portion 46 of the present embodiment, will be described. FIG. 7 and FIG. 8 are cross-sectional views of portions near nip portions N of the manual sheet feed portion 46X and the manual sheet feed portion 46Y, respectively.

As shown in FIG. 7, the manual sheet feed portion 46X includes a separation pad 72X similar to the separation pad 72 of the present embodiment. The separation pad 72X is supported by a pad holder 71X. An uppermost sheet SX in a stack of sheets stacked on a not-illustrated sheet stacking portion is conveyed downstream in the sheet conveying direction (an arrow DS) according to rotation (an arrow DR) of a sheet feed roller 461X. At this time, the leading end of the sheet SX may enter a gap between an upstream-side end portion 72X1 of the separation pad 72X and a wall surface 71H1 of the pad holder 71X (region Z). As a result, the leading end portion of the sheet SX may be bent and the sheet may not be appropriately conveyed.

On the other hand, the manual sheet feed portion 46Y as shown in FIG. 8 includes a film sheet 75 in addition to a separation pad 72Y and a pad holder 74. The film sheet 75 is a sheet member formed as a PET film. A lower end portion 751 of the film sheet 75 is adhered and fixed to a side surface portion 741 of the pad holder 74, to form a fixed end of the film sheet 75. An upper end portion 752 of the film sheet 75 forms a free end of the film sheet 75. The upper end portion 752 of the film sheet 75 extends so as to cover a gap between an upstream-side end portion 72Y1 of the separation pad 72Y and a wall surface 74H1 of the pad holder 74. In the manual sheet feed portion 46Y having such a structure, the leading end of a sheet SY conveyed by a sheet feed roller 461Y is guided toward the nip portion N by the upper end portion 752 of the film sheet 75. Therefore, the leading end of the sheet SY is less likely to enter the gap between the upstream-side end portion 72Y1 of the separation pad 72Y and the wall surface 74H1 of the pad holder 74.

However, in the manual sheet feed portion 46Y as described above, the number of components of the manual sheet feed portion 46Y is increased by the film sheet 75 being disposed. As a result, cost for the manual sheet feed portion 46Y is increased. Further, in production of the manual sheet feed portion 46Y, assembling steps are increased by the film sheet 75 being adhered and fixed to the pad holder 74.

In order to solve the aforementioned problems, in the manual sheet feed portion 46 of the present embodiment, the ribs 715 are used to stably convey a sheet toward the nip portion N. Next, an action of the manual sheet feed portion 46 of the present embodiment will be described with reference to FIG. 5 and FIG. 6. FIG. 5 and FIG. 6 are enlarged cross-sectional views of a portion near the nip portion N of the manual sheet feed portion 46.

As described above, when the manual feed lifting plate 46B (FIG. 3) is moved upward, and the sheet feed roller 461 is rotated (the arrow DR in FIG. 5), the sheet S is conveyed in the direction indicated by an arrow DS1. At this time, due to frictional force among sheets, several sheets S may be conveyed in the direction indicated by the arrow DS1. The leading end of the sheet S conveyed by the sheet feed roller 461 contacts with the contact surface 712 of the pad holder 71 as shown in FIG. 5. At this time, an angle between the leading end of the sheet S and the contact surface 712 is defined as θ1. The sheet S (sheet S(1) in FIG. 6) that contacts with the contact surface 712, is conveyed toward the nip portion N while frictionally sliding on the contact surface 712 due to rotational force of the sheet feed roller 461 (sheet S(2) in FIG. 6). Thereafter, the sheet S is conveyed toward the separation surface 72A along the inclined surfaces 715A of the ribs 715 (an arrow DS2 in FIG. 6). In the present embodiment, an angle between the inclined surface 715A of the rib 715 and the separation surface 72A is defined as θ2, and a relationship of θ1>θ2 is satisfied. Therefore, the leading end of the sheet S contacts with the contact surface 712 at an entering angle θ1, and thereafter contacts with the separation surface 72A at an entering angle θ2 that is less than the angle θ1. Therefore, when the sheet S contacts with the separation surface 72A, a load on the sheet S is advantageously reduced. Further, since the sheet S does not hit against the separation surface 72A at a great angle, the leading end portion of the sheet S is prevented from being bent. As a result, the sheet S is stably conveyed toward the nip portion N.

In the present embodiment, as described above, since the ribs 715 are disposed on both side portions of the separation pad 72, the sheet S is conveyed toward the nip portion N in a state where the sheet S smoothly contacts with the separation surface 72A of the separation pad 72. Therefore, the film sheet 75 as provided in the manual sheet feed portion 46Y described above need not be provided in order to cause the sheet S to stably contact with the separation surface 72A. Therefore, the number of components of the manual sheet feed portion 46 is reduced, and cost for the manual sheet feed portion 46 is reduced. Further, steps of assembling the manual sheet feed portion 46 is advantageously reduced.

Even in a case where plural sheets S are conveyed toward the separation pad 72 due to rotational force of the sheet feed roller 461 and frictional force among the sheets S as described above, only an uppermost sheet S (the sheet closest to the sheet feed roller 461) is conveyed toward the nip portion N by the sheet feed roller 461 due to frictional force between the sheet S and the separation surface 72A. In other words, brake is applied to the sheets S other than the uppermost sheet due to frictional force between the sheets and the separation surface 72A.

Further, in the present embodiment, the inclined surfaces 715A of the ribs 715 extend so as to connect between the contact surface 712 and the support surface 714 (FIG. 6). In other words, when a cross-section intersecting the sheet width direction is viewed, each inclined surface 715A extends so as to intersect the separation surface 72A, and extends such that the inclined surface 715A has its front end portion lowered toward the downstream side in the sheet conveying direction so as to be lower than the separation surface 72A. Therefore, in a region upstream of the nip portion N in the sheet conveying direction, the downstream-side portion, in the sheet conveying direction, of the inclined surface 715A is positioned so as to be lower than the separation surface 72A. As a result, even when plural sheets S are conveyed, the sheets other than the uppermost sheet are allowed to contact with the separation surface 72A.

Further, in the present embodiment, as shown in FIG. 6, the upstream-side end portion 72B on the upstream side, in the sheet conveying direction, of the separation pad 72 is disposed so as to face the step surface 71D1 of the stepped portion 71D between the contact surface 712 and the support surface 714. The inclined surfaces 715A are positioned downstream of the step surface 71D1 in the sheet conveying direction. Therefore, the leading end of the sheet S which contacts with the contact surface 712 is guided toward the separation surface 72A so as to move over the gap between the stepped portion 71D and the upstream-side end portion 72B of the sheet feed pad due to the ribs 715. As a result, the leading end of the sheet S is prevented from entering the gap between the separation pad 72 and the stepped portion 71D. Therefore, bending of the sheet S is advantageously reduced. Further, the parallel surfaces 715B are disposed between the contact surface 712 and the respective inclined surfaces 715A. Therefore, the leading end of the sheet S which contacts with the contact surface 712 is guided to the separation surface 72A due to the parallel surfaces 715B without entering the gap between the stepped portion 71D and the upstream-side end portion 72B of the sheet feed pad.

The manual sheet feed portion 46 and the image forming apparatus 1 including the manual sheet feed portion 46 according to the embodiment of the present disclosure, are described above. However, the present disclosure is not limited thereto. For example, modifications described below may be implemented.

In the above embodiment, the manual sheet feed portion 46 is described as a sheet feed apparatus including the sheet feed roller 461 and the separation pad portion 7. However, the present disclosure is not limited thereto. The sheet feed apparatus may be the sheet feed portion 40 that includes the first sheet feed cassette 40A and the second sheet feed cassette 40B. Also in this case, the sheet S1 is stably fed from the first sheet feed cassette 40A or the second sheet feed cassette 40B. Further, the sheet feed apparatus may be the document conveying portion 22, in the automatic document feeder (ADF) 20, which feeds a document to a reading position. In this case, the image forming apparatus 1 includes an image reading apparatus described below and the image forming portion 30. The image reading apparatus included in the image forming apparatus 1 has: a sheet feed apparatus that has the sheet feed roller 461 and the separation pad portion 7; and the reading unit 25 (reading means) that is disposed so as to face the sheet conveying path of the sheet feed apparatus, and that reads a document image on a sheet. The image forming portion 30 forms an image on a sheet based on the document image read by the reading unit 25. Also in this case, a document is stably fed from the document tray 21 and an image is stably formed on a sheet.

In the embodiment described above, each rib 715 is a part of the pad holder 71. However, the present disclosure is not limited thereto. The ribs 715 may be support members that are separate from the pad holder 71 and that are fixed to the pad holder 71.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A sheet feed apparatus comprising:

a sheet stacking portion on which sheets are stacked;

a sheet conveying path, extending from the sheet stacking portion, in which the sheet is conveyed in a predetermined conveying direction;

a sheet feed roller disposed, in the sheet conveying path, facing the sheet stacking portion and having a circumferential surface being rotated, the sheet feed roller configured to convey the sheet;

a sheet feed pad disposed facing the circumferential surface of the sheet feed roller, and having a pad surface that forms, between the pad surface and the circumferential surface, a nip portion into which the sheet is conveyed;

a support member having a support surface to which the sheet feed pad is fixed, and a contact surface located upstream of the support surface in a sheet conveying direction so as to be higher than the pad surface, the contact surface being parallel to the support surface and configured to make contact with a leading end of the sheet fed from the sheet stacking portion; and rib portions disposed in the support member on both side portions, in a sheet width direction intersecting the sheet conveying direction, of the support surface, the rib portions having inclined surfaces that extend so as to lower front end portions thereof, respectively, from the contact surface toward a downstream side in the sheet conveying direction.

2. The sheet feed apparatus according to claim 1, wherein, in a case where a cross-section intersecting the sheet width direction is viewed, when $\theta 1$ represents an angle that is formed between a leading end of the sheet and the contact surface when the sheet contacts with the contact surface, and $\theta 2$ represents an angle between the pad surface and each inclined surface of each rib portion, a relationship of $\theta 1 > \theta 2$ is satisfied.

3. The sheet feed apparatus according to claim 2, wherein, in a case where the cross-section intersecting the sheet width direction is viewed, the inclined surfaces extend so as to intersect the pad surface, and extend so as to lower the front end portions toward the downstream side in the sheet conveying direction such that the front end portions of the inclined surfaces are lower than the pad surface.

4. The sheet feed apparatus according to claim 3, wherein the support member has a stepped portion that is erected from the support surface toward the contact surface, an end portion on an upstream side, in the sheet conveying direction, of the sheet feed pad is positioned on the support surface side so as to face a step surface of the stepped portion, and the rib portions are disposed downstream of the step surface in the sheet conveying direction.

5. The sheet feed apparatus according to claim 4, wherein the rib portions have parallel surfaces disposed, between the respective inclined surfaces and the contact surface, so as to connect between the contact surface and the respective inclined surfaces, and be parallel to the contact surface.

6. The sheet feed apparatus according to claim 2, wherein the support member has a stepped portion that is erected from the support surface toward the contact surface, an end portion on an upstream side, in the sheet conveying direction, of the sheet feed pad is positioned on the support surface side so as to face a step surface of the stepped portion, and the rib portions are disposed downstream of the step surface in the sheet conveying direction.

7. The sheet feed apparatus according to claim 2, wherein the rib portions have parallel surfaces disposed, between the respective inclined surfaces and the contact surface, so as to connect between the contact surface and the respective inclined surfaces, and be parallel to the contact surface.

8. The sheet feed apparatus according to claim 1, wherein, in a case where a cross-section intersecting the sheet width direction is viewed, the inclined surfaces extend so as to intersect the pad surface, and extend so as to lower the front end portions toward the downstream side in the sheet conveying direction such that the front end portions of the inclined surfaces are lower than the pad surface.

9. The sheet feed apparatus according to claim 8, wherein the support member has a stepped portion that is erected from the support surface toward the contact surface, an end portion on an upstream side, in the sheet conveying direction, of the sheet feed pad is positioned on the support surface side so as to face a step surface of the stepped portion, and the rib portions are disposed downstream of the step surface in the sheet conveying direction.

10. The sheet feed apparatus according to claim 1, wherein the support member has a stepped portion that is erected from the support surface toward the contact surface, an end portion on an upstream side, in the sheet conveying direction, of the sheet feed pad is positioned on the support surface side so as to face a step surface of the stepped portion, and the rib portions are disposed downstream of the step surface in the sheet conveying direction.

11. The sheet feed apparatus according to claim 1, wherein the rib portions have parallel surfaces disposed, between the respective inclined surfaces and the contact surface, so as to connect between the contact surface and the respective inclined surfaces, and be parallel to the contact surface.

12. An image forming apparatus comprising:

a sheet stacking portion on which sheets are stacked;

a sheet conveying path, extending from the sheet stacking portion, in which the sheet is conveyed in a predetermined conveying direction;

a sheet feed roller disposed, in the sheet conveying path, facing the sheet stacking portion, and having a circumferential surface being rotated, the sheet feed roller configured to convey the sheet;

a sheet feed pad disposed facing the circumferential surface of the sheet feed roller, and having a pad surface that forms, between the pad surface and the circumferential surface, a nip portion into which the sheet is conveyed;

a support member having a support surface to which the sheet feed pad is fixed, and a contact surface located upstream of the support surface in a sheet conveying direction so as to be higher than the pad surface, the contact surface being parallel to the support surface and configured to make contact with a leading end of the sheet fed from the sheet stacking portion;

rib portions disposed in the support member on both side portions, in a sheet width direction intersecting the sheet conveying direction, of the support surface, the rib portions having inclined surfaces that extend so as to lower front end portions thereof, respectively, from the contact surface toward a downstream side in the sheet conveying direction; and an image forming portion that forms an image on the sheet conveyed by the sheet feed roller.

13. The image forming apparatus according to claim 12, wherein the sheet stacking portion is a manual feed tray.

14. The image forming apparatus according to claim 12, further comprising a reading portion configured to read an image on a document and disposed so as to face the sheet conveying path; and a document conveying unit configured to convey a document to the reading portion through the sheet conveying path, wherein the image forming portion forms an image on the sheet based on the document image read by the reading portion.

15. A document conveying apparatus attached to an image reading apparatus and conveying a document to the image reading apparatus, the document conveying apparatus comprising:

a sheet stacking portion on which documents are stacked;

a sheet conveying path, extending from the sheet stacking portion, in which the document is conveyed in a predetermined conveying direction;

a sheet feed roller disposed, in the sheet conveying path, facing the sheet stacking portion, and having a circumferential surface being rotated, the sheet feed roller configured to convey the document;

a sheet feed pad disposed facing the circumferential surface of the sheet feed roller, and having a pad surface that forms, between the pad surface and the circumferential surface, a nip portion into which the document is conveyed;

a support member having a support surface to which the sheet feed pad is fixed, and a contact surface located upstream of the support surface in a sheet conveying direction, so as to be higher than the pad surface, the contact surface being parallel to the support surface and configured to make contact with a leading end of the document fed from the sheet stacking portion; and rib portions disposed in the support member on both side portions, in a sheet width direction intersecting the sheet conveying direction, of the support surface, the rib portions having inclined surfaces that extend so as to lower front end portions thereof, respectively, from the contact surface toward a downstream side in the sheet conveying direction.

* * * * *